US006951432B1

(12) United States Patent
Chang et al.

(10) Patent No.: US 6,951,432 B1
(45) Date of Patent: Oct. 4, 2005

(54) FOLDER

(76) Inventors: Jui Lin Chang, No.9, Gongye 22th Rd., Nantun District, Taichung City (TW); Shu-Hua Shih, No. 258, Yung Ming St., Ta Li City, Taichung Hsien (TW)

( * ) Notice: Subject to any disclaimer, the term of this patent is extended or adjusted under 35 U.S.C. 154(b) by 0 days.

(21) Appl. No.: 10/779,307

(22) Filed: Feb. 17, 2004

(51) Int. Cl.[7] ..... B42F 13/00
(52) U.S. Cl. ..... 402/73; 229/67.1; 402/80 R; 402/500; D19/26
(58) Field of Search ..... 402/73, 80 R, 402/80 P, 500, 502; D19/26, 27; 229/67.1

(56) References Cited

U.S. PATENT DOCUMENTS 4,274,537 A * 6/1981 Cooper ..... 206/726
4,883,381 A * 11/1989 Pisciotti et al. ..... 402/74
6,241,414 B1 * 6/2001 Wien ..... 402/73
6,612,771 B1 * 9/2003 Su ..... 402/57
6,659,676 B2 * 12/2003 Zheng ..... 402/60

* cited by examiner

*Primary Examiner*—Monica S. Carter
(74) *Attorney, Agent, or Firm*—Harrison & Egbert

(57) ABSTRACT

A folder includes a board with one or more folding marks provided at the central position. The folding mark can separate the board into two folding panel boards. And, a folder body is provided at the inner face of a panel board adjacent to the folding mark, where a folder will take shape to hold the documents. The board is made of multi-layered sheets, with its middle layer including one or more foamed plastic layers. And, two plastic surface layers are attached to the surfaces of both sides of the middle layer. Thereupon, it is possible to enhance the ruggedness of the folder 20, reduce the manufacturing cost and offer more chromatism and diversity.

3 Claims, 6 Drawing Sheets

FOLDER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a folder, and more particularly to a folder which is made of special boards to reduce cost, bring out more chromatism and diversity for a more compact and convenient design.

BACKGROUND OF THE INVENTION

The conventional folder is generally made of paper or plastic boards. The disadvantages are as follows:

1. As the folder requires binding and bearing of documents internally, thin paperboard will make the folder too soft to bear the weight of documents or withstand the external force. If the thickness of paperboard is increased, the paper folder will become uneconomical owing to a higher cost of paper as compared to plastics. Even if its ruggedness is improved by increasing the thickness of paperboard, the paper folder will be softened as it is impossible to block off the humid air or water.

2. In an effort to reduce the cost and improve the quality of paper folder, the present invention has created a folder by plastic board. However, this soft folder is unable to bear the weight of documents in the presence of thin plastic board. Additionally, the plastic board is made of monochromatic molding materials, which cannot bring chromatism and diversity for the folder.

3. Either conventional paper folders or plastic folders are unavailable with lightweight advantage. If there are many files in the cumbersome folder, the end-user must hold it in the palm or carry it by both hands, more particularly to female users. Thus, conventional folders are really hard-to-carry.

Based upon years of experience in R&D and design of this product, the present invention has offered a utility model after detailed evaluation and careful design.

BRIEF SUMMARY OF THE INVENTION

The present invention can offer an improved efficiency as detailed below:

1. The board 10 of the folder 20 in present invention is constructed of foamed plastic materials as its middle layer 101. And, two surface layers 102 103 are separately attached to the surfaces of both sides of the middle layer 101. Thereupon, it is possible to enhance the ruggedness of the folder 20 and reduce its manufacturing cost as compared to paper folder.

2. Constructed of multi-layered plastic boards 10, the folder 20 in the present invention can bring more chromatism through its middle layer 101 and two surface layers 102 103. Thus, this folder is able to offer a flexible color scheme for its diversified colors.

3. If there are many files in the folder 20, the end-user may hold it by the carrying handle 21 (as shown in FIG. 4). And, the folder 20 can hang on the wall surface or other places by its hanger 22, thereby making it more convenient to carry or store the documents.

DETAILED DESCRIPTION OF THE INVENTION

Figure 1:
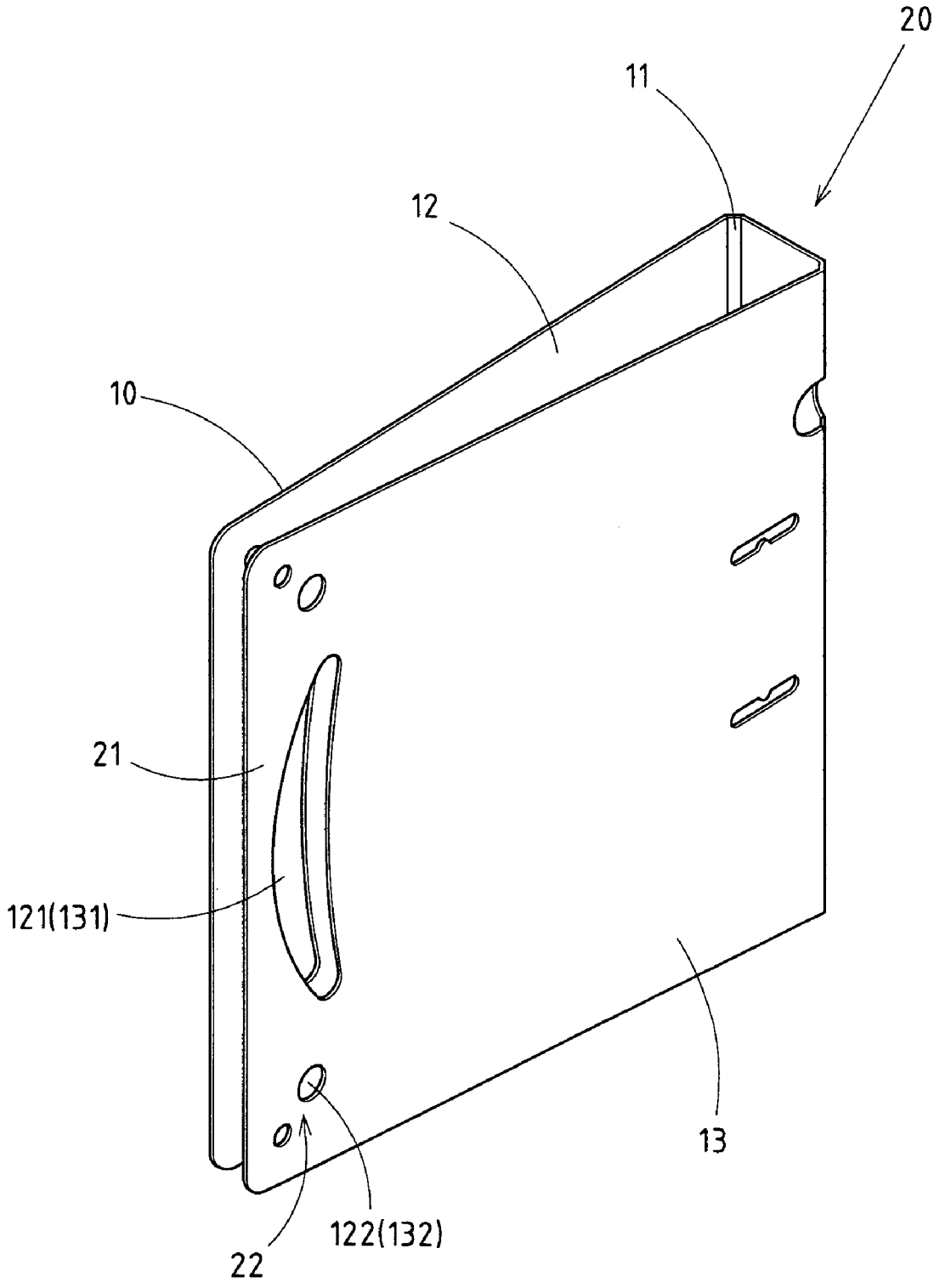
FIG. 1 shows a perspective view of the present invention.

The features and the advantages of the present invention will be more readily understood upon a thoughtful deliberation of the following detailed description of a preferred embodiment of the present invention with reference to the accompanying drawings.

As shown in FIGS. 1–4, a folder embodied in the present invention comprises a board 10, available with one or more folding marks 11 in its central position. The folding mark 11 can separate the board 10 into two folding panel boards 12 13. And, a folder body 14 is provided at the inner face of a panel board 12 adjacent to the folding mark 11, where a folder 20 will take shape to hold the files.

The board 10 is made of multi-layered sheets, with its middle layer 101 comprising of one or more foamed plastic layers. And, two plastic surface layers 102 103 are attached to the surfaces of both sides of the middle layer 101. Thereupon, it is possible to enhance the ruggedness of the folder 20, reduce the manufacturing cost and offer more chromatism and diversity.

Figure 6:
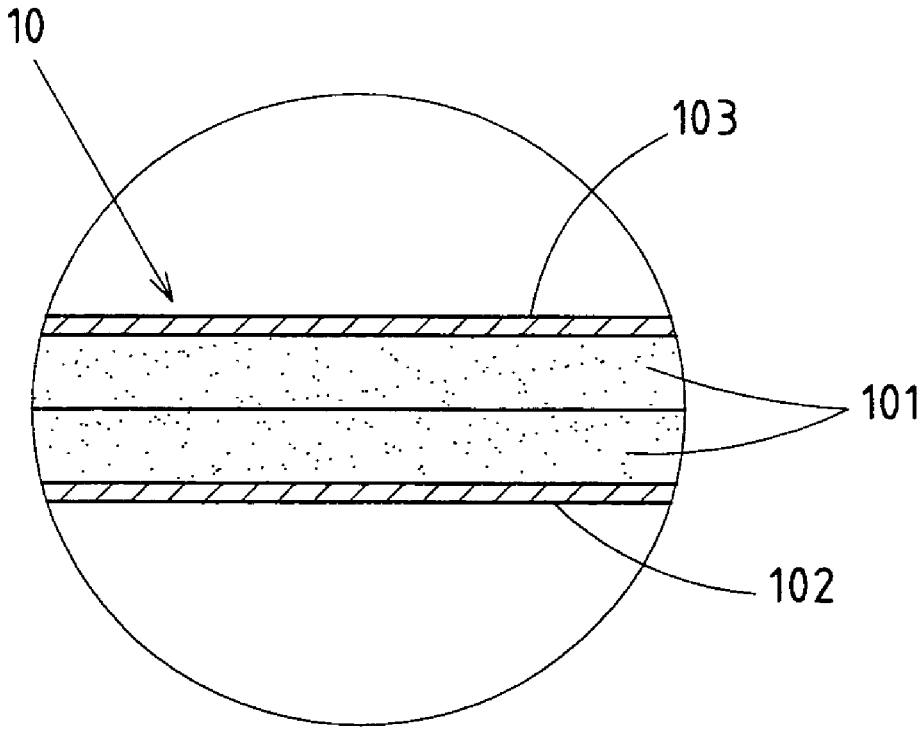
FIG. 6 shows a cross-sectional view of another example of the folder board.

As shown in FIG. 6, the middle layer 101 of the board 10 is made of multi-layered foamed plastics.

Figure 2:
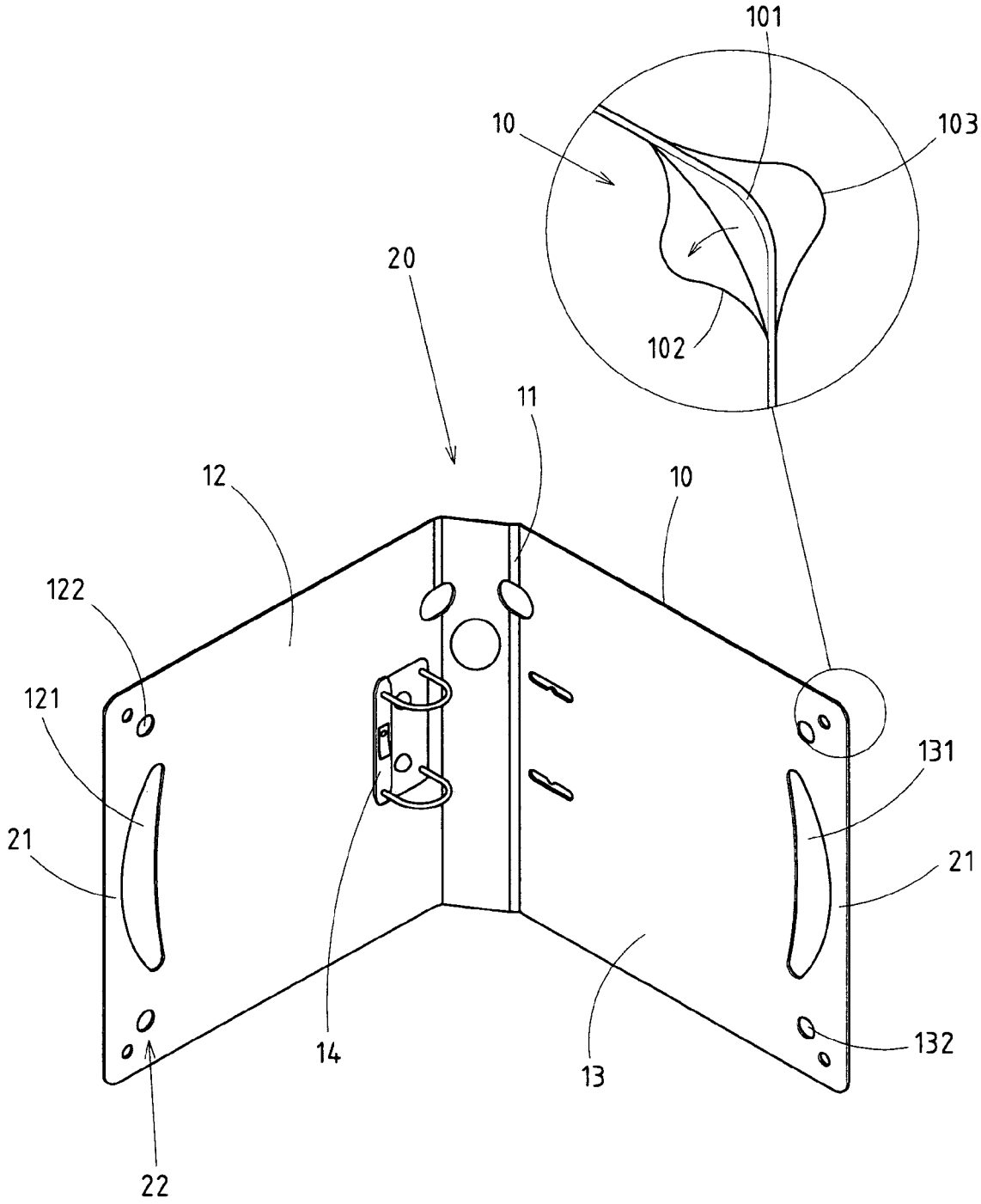
FIG. 2 shows a perspective view of the unfolded folder.
Figure 3:
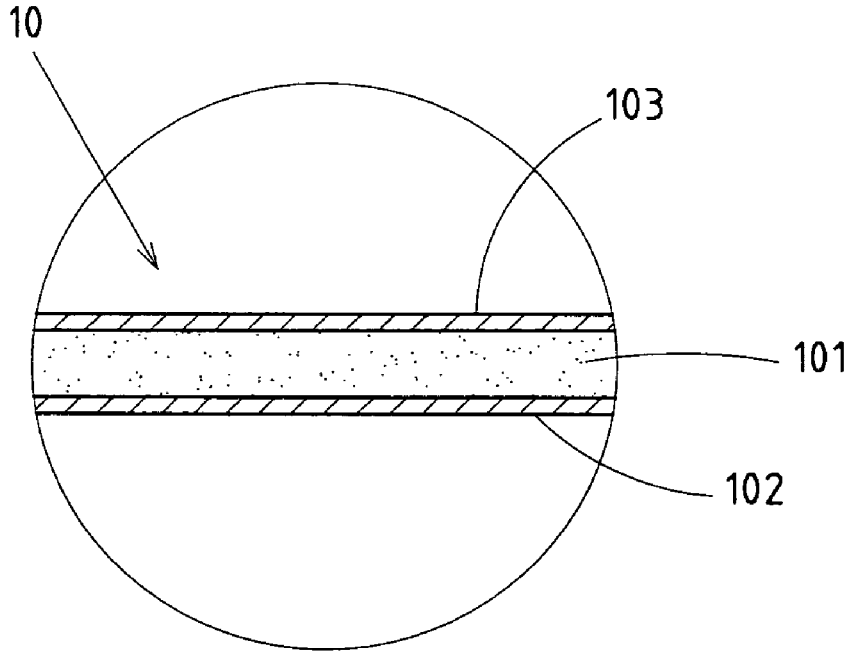
FIG. 3 shows a cross-sectional view of the folder board.
Figure 4:
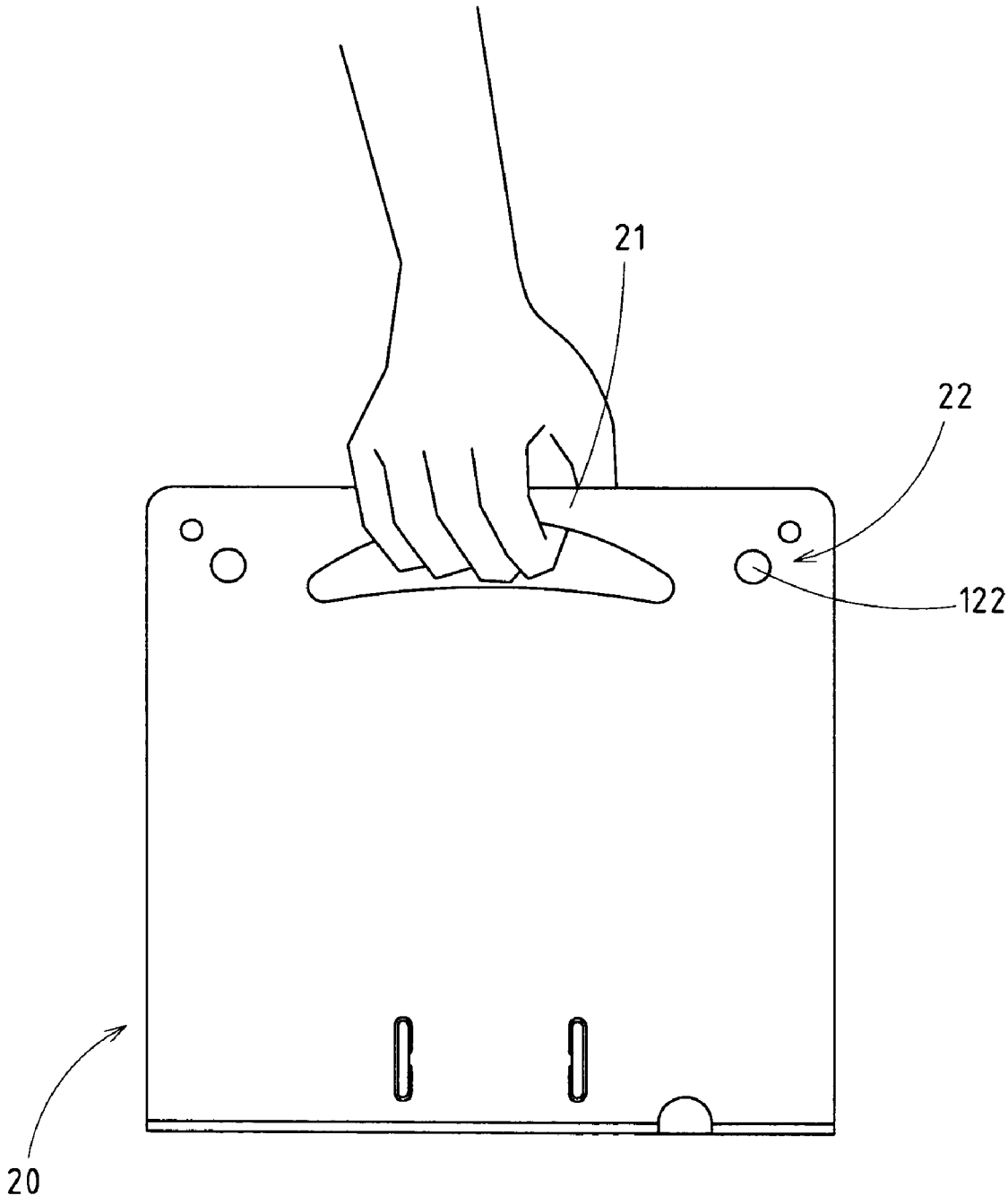
FIG. 4 shows a plain elevation view of the carrying folder.
Figure 5:
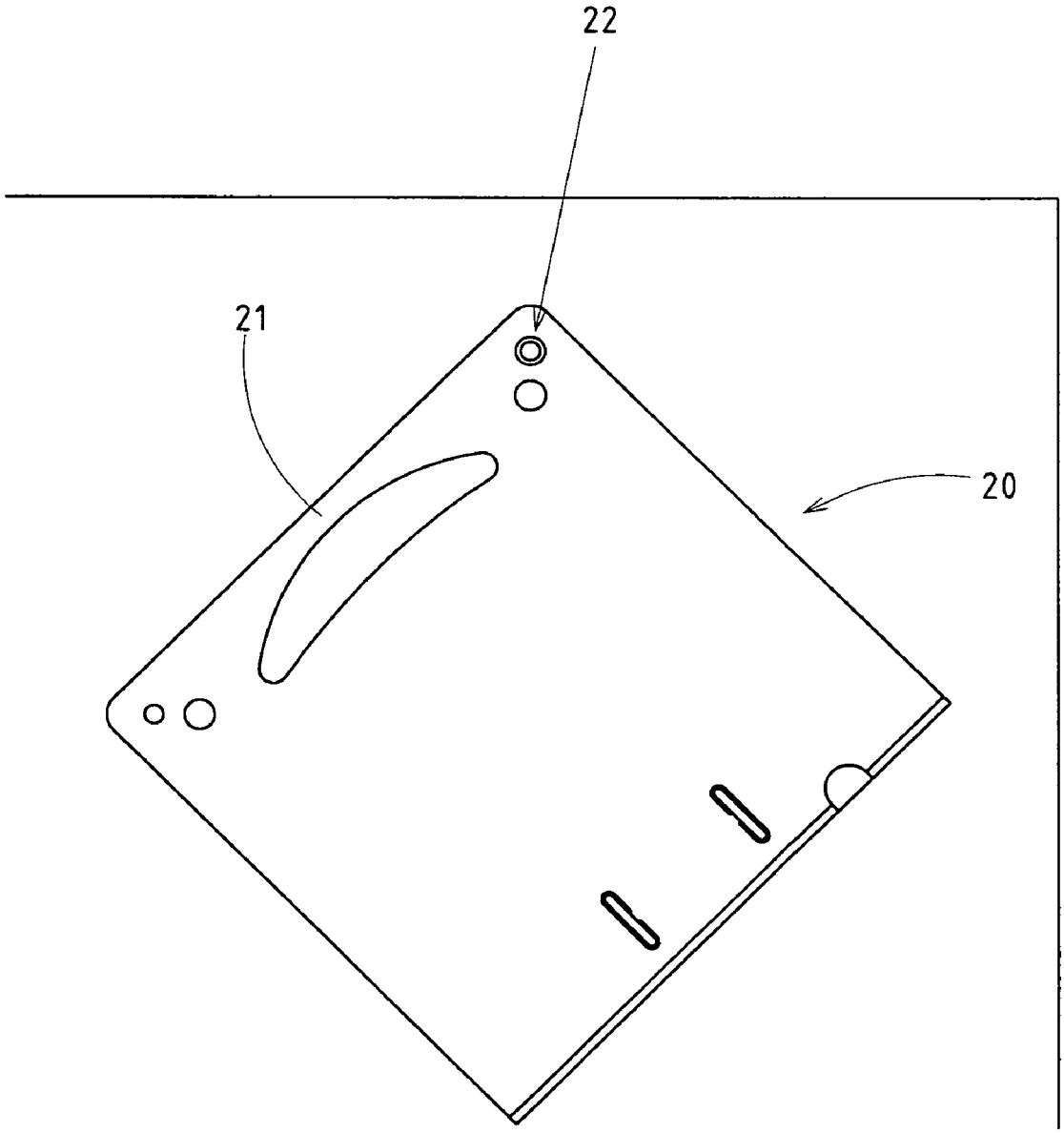
FIG. 5 shows a plain elevation view of the hanging folder.

As shown in FIG. 2, the middle layer 101 and two surface layers 102 103 of the board 10 can bring more chromatism.

As shown in FIGS. 1, 2, 4, and 5, one or more folding marks 11 is provided at the central position of the board 10. The folding mark 11 can separate the board 10 into two folding panel boards 12 13. And, a folder body 14 is provided at the inner face of a panel board 12 adjacent to the folding mark 11, where a folder will take shape to hole the documents. Two grip holes 121 131 or open holes 122 132 is arranged at the same side of two panel boards 12 13 of the folder 20, where carrying handle 21 or hanger 22 is provided for more convenient applications.

What is claimed is:

1. A folder comprising:

a board having at least one fold line extending thereacross adjacent a central area of said board, the fold line separating said board into at least two folding panels; and a folder body affixed to an inner face of one of the folding panels adjacent to the fold line, said board having a plastic outer layer and a plaster inner layers and a middle layer, said middle layer being of a foamed polymeric material, said inner and outer layer being directly affixed to opposite surfaces of said middle layer, each of the folding panels having a grip hole formed entirely through said layers, the grip hole of one folding panel aligning with the grip hole of another folding panel when the folding panels are folded over each other, each of the folding panels having no fold lines adjacent the grip hole nor interposed between the fold line and the grip hole, each of said folding panels having a hanging hole formed entirely through said layers, the hanging hole of one folding panel aligning with the hanging hole of another folding panel when the folding panels are folded over each other.

2. The folder of claim 1, said middle layer being of a multi-layered foamed polymeric material.

3. The folder of claim 1, said inner layer and said outer layer being of different colors.

* * * * *